US006052545A

United States Patent [19]

Komiya et al.

[11] Patent Number: 6,052,545

[45] Date of Patent: Apr. 18, 2000

[54] IMAGE FORMING APPARATUS

[75] Inventors: Yoshiyuki Komiya; Atsushi Takeda, both of Mishima; Fumiteru Gomi, Shizuoka-ken; Kouichi Hashimoto, Numazu, all of Japan

[73] Assignee: Canon Kabushiki Kaisha, Tokyo, Japan

[21] Appl. No.: 09/162,157

[22] Filed: Sep. 29, 1998

[30] Foreign Application Priority Data

Sep. 30, 1997 [JP] Japan ..... 9-282996

[51] Int. Cl.[7] ..... G03G 15/00; G03G 15/02; G03G 15/09

[52] U.S. Cl. ..... 399/61; 399/30; 399/63; 399/149; 399/175

[58] Field of Search ..... 399/175, 159, 399/30, 61, 62, 149, 150, 58; 430/56, 57, 83

[56] References Cited

U.S. PATENT DOCUMENTS

| | | | |
|---|---|---|---|
| 4,999,676 | 3/1991 | Mouri | 399/30 |
| 5,214,476 | 5/1993 | Nomura et al. | 399/30 |
| 5,319,423 | 6/1994 | Takeda et al. | 399/298 |
| 5,486,905 | 1/1996 | Takeda et al. | 399/253 |
| 5,519,316 | 5/1996 | Hagiwara et al. | 324/204 |
| 5,589,915 | 12/1996 | Hashimoto | 399/120 |
| 5,659,852 | 8/1997 | Chigono et al. | 399/175 |
| 5,822,659 | 10/1998 | Ishiyama | 399/175 |
| 5,870,656 | 2/1999 | Hibino et al. | 399/149 |
| 5,890,038 | 3/1999 | Ohsawa et al. | 399/228 |

FOREIGN PATENT DOCUMENTS

| | | |
|---|---|---|
| 580014A2 | 1/1994 | European Pat. Off. . |
| 708376A2 | 4/1996 | European Pat. Off. . |
| 789284A1 | 8/1997 | European Pat. Off. . |
| 844536A2 | 5/1998 | European Pat. Off. . |
| 1936815 | 2/1970 | Germany . |
| 4368975 | 12/1992 | Japan . |
| 6-3921 | 1/1994 | Japan . |

*Primary Examiner*—Sophia S. Chen
*Attorney, Agent, or Firm*—Fitzpatrick, Cella, Harper & Scinto

[57] ABSTRACT

An image forming apparatus includes an image bearing member and a charging unit having magnetic particles that are contactable with the image bearing member. An electrostatic image forming unit forms an electrostatic image on the charged image bearing member. A developing device develops an electrostatic image on the image bearing member with toner that includes toner and magnetic carrier. A detecting unit detects the toner content of the developer and a toner supply unit supplies the toner into the developing unit when the detected toner content is lower than a predetermined level. A calculating unit calculates the changing rate of the toner content from an output of the detecting unit and a warning unit warns that a changing rate of the toner content is larger than a predetermined level.

10 Claims, 4 Drawing Sheets

IMAGE FORMING APPARATUS

FIELD OF THE INVENTION AND RELATED ART

The present invention relates to an image forming apparatus having a magnetic brush charger contactable to an image bearing member to charge an image bearing member.

A transfer type image forming apparatus has been widely used wherein an image is formed by image forming process means including a charging means for charging a member to be charged(image bearing member) such as an electrophotographic photosensitive member or a dielectric member for electrostatic recording, image information writing means for forming an electrostatic latent image on the charged surface of the member to be charged, developing means for forming a toner image by developing an electrostatic latent image with a developer and transferring means for transferring a toner image on a transfer material, and wherein the toner image is transferred onto a transfer material, and the transferred image is fixed to provide a print (copy, print or the like), and the member to be charged is repeatedly used.

1) Contact charging device

As the charging means for charging the member to be charged to a predetermined polarity and potential, a corona charger has been widely used. In such means, a corona charger is disposed faced to the photosensitive drum without contact thereto, so that photosensitive drum surface is exposed to the corona emitted from the corona charger to charge the photosensitive drum surface to a predetermined polarity and potential.

Recently, a contact charging type charging device (contact charging device) has been put into practice since it is advantageous in low ozone production, low electric power consumption or the like as compared with the non-contact type. In this system, a contact charging member supplied with a voltage is contacted to the photosensitive drum, so that photosensitive drum surface is charged to a predetermined polarity and potential.

In a magnetic brush type contact charging device (magnetic brush contact charging device), electroconductive magnetic particles are magnetically confined on a carrying member, and magnetic brush portion of a magnetic brush charging member is contacted to the member to be charged, wherein the charging member has a bias voltage applied there to, by which the member to be charged is charged, and it is preferably used from the standpoint of stability of the charging contact.

In the magnetic brush charging member, electroconductive magnetic particles are directly confined on a magnet as a carrying member or magnetically confined on a sleeve enclosing a magnet, so that magnetic brush portion is formed, and is contacted to the member to be charged with or without rotation, and the charging is started by application of the voltage.

Alternatively, electroconductive fibers may be formed into a brush (furbrush member), or an electroconductive rubber is formed into a roller (electroconductive rubber roller(charging roller).

When such a contact charging member is used with a member to be charged having a normal organic photosensitive member on which surface layer having a dispersed electroconductive fine particles (charge injection layer) is provided, or an amorphous silicon photosensitive member or the like, the charged potential of the surface of the member to be charged is substantially equivalent to the DC component of the bias application to the contact charging member (Japanese Laid-open Patent Application No. HEI-6-3921).

Such a charging method is called here "injection charging" (charging of the member to be charged by direct injection of the charge at the contact portion).

The injection charging does not use the discharge phenomenon which has been used in the corona charger, so that complete ozoneless charging can be accomplished together with the low electric power consumption, and therefore, it is noted.

2) Developing device 4

The developing means for forming a toner image by development of an electrostatic latent image with a developer is classified generally into 4 types.

a. Non-magnetic toner is applied on a sleeve using a blade or the like, and magnetic toner is applied on a sleeve using magnetic force, and the toner is carried to the developing zone where the toner is faced to the photosensitive drum without contact thereto (one component non-contact development).

b. The toner applied in the same manner is contacted to the photosensitive drum (one component contact development).

c. The developer is a mixture of toner particles and magnetic carrier particles, and is carried by magnetic force to a developing zone where it is contacted to the photosensitive drum (two component contact development).

d. Such a two component developer is not contacted to the photosensitive member (two component non-contact development).

In a developing device using a two component developer, the toner in the developer is gradually consumed with development for the electrostatic latent image, and if the toner supplement is not carried out, the toner content of the developer (mixing ratio of the toner particle and the magnetic carrier, T/C ratio) gradually decreases with the result that image density decreases, too.

Therefore, a means is provided to detect the toner content of the developer in the developing device, and on the basis of the toner content detected information, the toner is supplied from the supplement portion into the developing device corresponding to the toner consumed by the development, by which the T/C ratio of the developer is maintained in a predetermined range (developer density control system).

In this case, as a method for detecting a toner content, namely, T/C ratio of the developer in the developing device, various methods have been proposed. For example, (1) a detecting means is provided faced to the photosensitive drum as the member to be charged, and light is projected onto the toner transferred from the developing sleeve to the photosensitive drum, and the T/C ratio is detected on the basis of the transmission factor and the reflectance at this time.

(2) a detecting means is provided on a developing sleeve, and the T/C ratio is detected from the reflected light from the developer applied on the developing sleeve.

(3) a sensor is provided in the developing container to detect a T/C ratio by detecting a change of an apparent magnetic permeability $\mu$ change of the magnetic carrier included in the developer in a predetermined volume adjacent the sensor, using an inductance of the coil.

However, (1) the method of detecting the T/C ratio on the basis of the development toner amount on the photosensitive drum involves a problem that it requires large space to place the detecting means, which is increasingly significant with the trend of downsizing.

(2) the method of detecting the T/C ratio on the basis of the reflected light from the developer applied on the developing sleeve, involves a problem that T/C ratio is not correctly detected when the detecting means is contaminated by the toner scattering.

(3) the method of detecting the T/C ratio on the basis of the detection of the change in the apparent magnetic permeability $\mu$ of the magnetic carrier included in the developer in a predetermined volume adjacent the sensor using an inductance of the coil (toner content detecting sensor), has the advantages that cost of the sensor itself is low, that it does not require large space, as contrasted to (1), and that it is free of influence by the toner scattering. Therefore, it is thought to be a proper T/C ratio detecting means in a low cost and small image forming apparatus.

In the toner content detecting sensor using the magnetic permeability change of the developer (3), an increase, for example, of the magnetic permeability means decrease of the T/C ratio in the developer in the predetermined volume, that is, the decrease of the toner content, and therefore, the toner supply is started. On the contrary, the decrease of the magnetic permeability means the increase of the T/C ratio in the developer of a predetermined volume, that is, the rising of the toner content in the developer, so that toner supply is stopped. In this manner, the T/C ratio is controlled.

3) Cleaner-less system (toner recycling system)

Recently, with the continued efforts for downsizing of the image forming apparatus, the size reduction of the entire image forming apparatus by downsizing of image formation process means such as; the charging, exposure, development, transfer, fixing, cleaning or the like means is reaching limitation.

Untransferred toner on the member to be charged after the transfer is collected by a cleaning means(cleaner) and is disposed of finally. However, from the standpoint of environmental health, the residual toner is preferably not produced.

In view of this, a so-called cleaner-less system type image forming apparatus has appeared, wherein the cleaner for said cleaning exclusively, is omitted from the apparatus, and the untransferred toner is collected from the member to be charged by developing means (simultaneous development and cleaning) and is reused by the developing means.

In the simultaneous development and cleaning operation, the small amount of the toner remaining on the member to be charged after the transfer, is removed by fog removing bias (a fog removing potential difference Vback which is a potential difference between the surface potential of the member to be charged and the DC voltage applied to the developing means) in the subsequent developing operation or operations. With this method, the untransferred toner is collected by the developing means and is used in the subsequent step or steps, so that no toner is to be disposed of, thus reducing the maintenance operation. Further, being cleanerless is quite advantageous in terms of space, allowing image forming apparatuses to be substantially reduced in size.

In an image forming apparatus of the magnetic brush contact charging, image transfer and cleaner-less system type, the toner particles remaining on the member to be charged after the toner image transfer onto the transfer material, are carried over to the charge station for the member to be charged, and is temporarily collected into the magnetic brush portion of a magnetic brush charging member in a magnetic brush contact charging device, and the toner particles thus temporarily collected are gradually ejected to the member to be charged by electrostatic force from the magnetic brush portion, so that it is carried on the member to be charged to the developing station where it is removed by the simultaneous development and cleaning.

Normally, the toner particles have relatively high electric resistance, and therefore, the introduction of the toner particles in the magnetic brush portion of the magnetic brush charging member, increases the resistance of the magnetic brush portion so that charging power is decreased. In a normal image formation process, however, the operations are in good order, since the amount of the untransferred toner introduced in the magnetic brush portion is small, since the toner is ejected to the member to be charged, and since the tolerable amount in the magnetic brush portion is relatively large.

The toner particles discharged onto the member to be charged from the magnetic brush portion are very uniformly distributed thereon, and the amount thereof is very small, and therefore, they do not adversely affect the image exposure process. Additionally, the production of the ghost image attributable to the untransferred toner pattern can be prevented.

However, when the apparatus is subjected to an emergent stop due to the sheet jam (jam), power failure or the like in the process of the image formation process, and then the operation is resumed, the large amount of the toner particle of the untransferred toner image remaining on the member to be charged before the stop, is collected by the magnetic brush portion of the magnetic brush charging member at once.

Then, the mixing toner content in the magnetic brush portion suddenly increases. If the amount thereof exceeds the tolerable level, the ejection of the toner from the magnetic brush portion becomes not enough with the result of decrease of the charging power due to the rise of the resistance of the magnetic brush portion, and therefore, the potential difference between the potential of the member to be charged and the potential applied to the magnetic brush charging member becomes so large that magnetic particles constituting the magnetic brush portion are deposited on the member to be charged from the magnetic brush portion, abnormally.

The magnetic particles removed from the magnetic brush portion are carried over to the developing station and are collected thereby, in the cleaner-less system.

Due to the decrease of the charging power attributable to the decrease of the magnetic particles from the magnetic brush portion (improper charging, charging non-uniformity or the like), the charged potential thereby does not reach to the predetermined potential, and due to the decrease of the charged potential of the member to be charged, the magnetic particle disengagement phenomenon is promoted. As a result, image defects may occur.

SUMMARY OF THE INVENTION

Accordingly, it is a principal object of the present invention to provide an image forming apparatus wherein the decrease of the magnetic particles in the charger can be properly detected.

It is another object of the present invention to provide an image forming apparatus wherein when the potential of the member to be charged decreases due to the decrease of the magnetic particles in the charger, the event is notified to the user without delay to prevent increase of the number of improper image formations.

It is a further object of the present invention to provide an image forming apparatus wherein the decrease of the amount of the magnetic particles in the charger is predicted on the basis of the increase of magnetic particles in the developing device.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

<Embodiment 1>

(1) Structure of an example of an image forming apparatus

Figure 1:
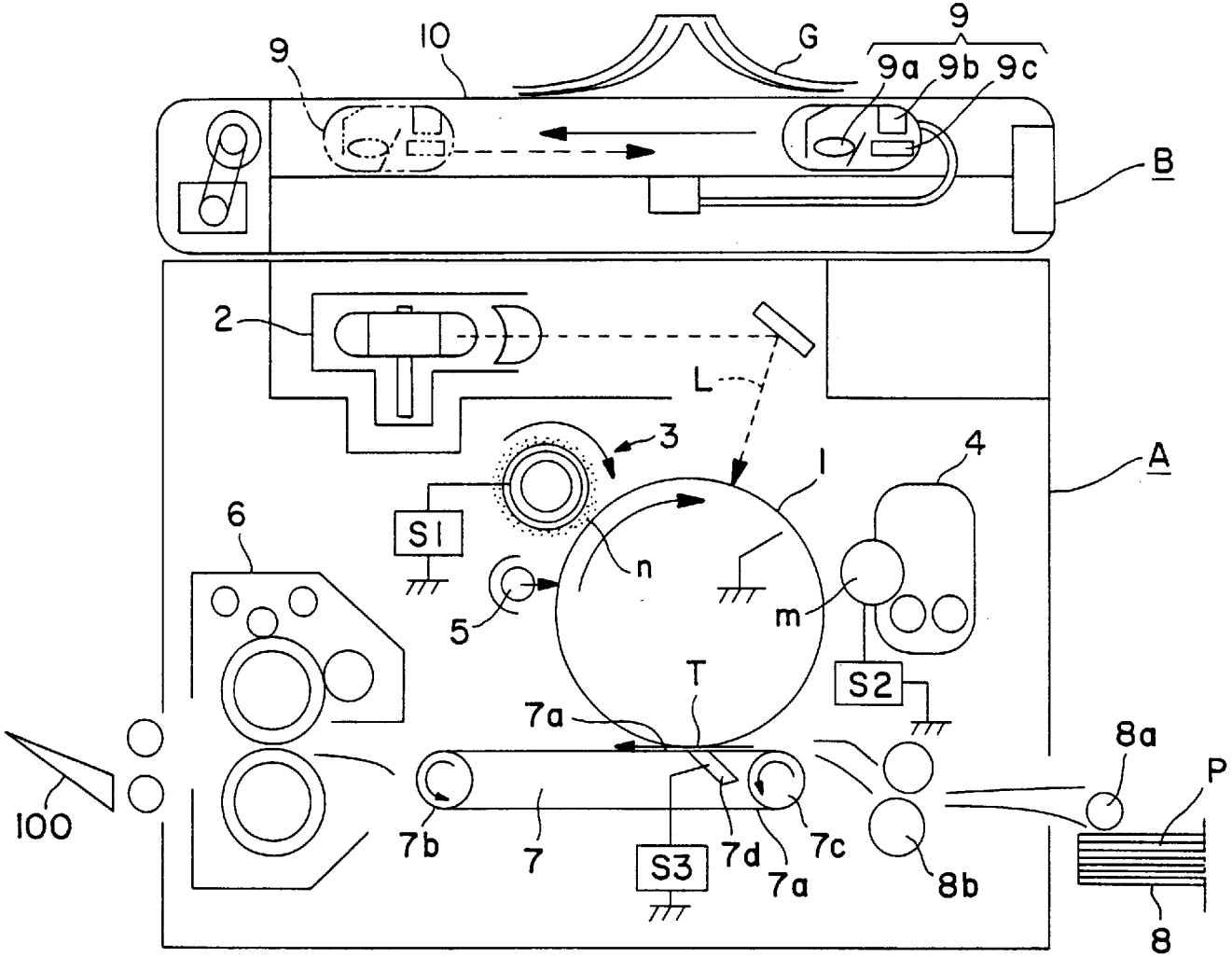
FIG. 1 is a schematic view of an image forming apparatus according to Embodiment 1.

FIG. 1 is a schematic view of an example of an image forming apparatus according to an embodiment of the present invention.

In this example, the image forming apparatus is shown as a laser beam printer of an image transfer type electrophotographic process type, magnetic brush contact charging type and cleaner-less system type.

Designated by A is a laser beam printer, and B is an image reader or scanner for reading an image, placed on the printer.

a) image reading apparatus B

In the image reading apparatus B, designated by 10 is an original supporting platen glass fixed on an upper surface of the apparatus, and on the original supporting platen glass an original G is placed face down thereon, and an unshown original cover is covered thereon.

Designated by 9 is an image reading unit (reader portion) an original illumination lamp 9*a*, a short focus lens array 9*b*, CCD sensor 9*c* and the like. The unit 9, upon actuation of an unshown copy key, is moved forward along a bottom surface of the glass from its home position at the right-hand portion, and upon arrival at a predetermined forward movement end portion, it is moved backward to the home position.

During the forward movement driving operation of the unit 9, the image surface of the set original G on the original supporting platen glass 10 is illuminated and scanned from the right-hand side to the left-hand side by the original projection lamp 9*a* of the unit 9, and the light reflected by the surface of the original is imaged on a CCD sensor 9*c* by the short focus lens array 9*b*.

The CCD sensor 9*c* comprises a light receiving portion, a transfer portion and an Output portion. A light signal is converted to a charge signal by the light receiving CCD portion, and the charge signal is transferred to an output portion in synchronization with clock pulses by a transfer portion. In the output portion, the charge signal is converted to a voltage signal, which is then amplified with impedance reduction treatment, and the resultant signal is outputted. The analog signal provided in this manner, is subjected to a known image processing, so that digital signal is produced and is fed to the printer A.

Namely, the image reading device B carries out photoelectric reading of the image information of the original G and conversion thereof to a time series electrical digital pixel signal(image signal).

b) printer A

In a printer A, designated by 1 is an electrophotographic photosensitive member(photosensitive drum) of a rotatable drum type as a member to be charged. The photosensitive member of this example is a negative chargeable OPC photosensitive member having a surface charge injection layer. The photosensitive member 1 will be described in detail hereinafter (2).

The photosensitive drum 1 is rotated about a center thereof in the clockwise direction indicated by an arrow at a predetermined peripheral speed, at rotational speed of 100 mm/sec in this example, and in the rotation process it is subjected to a whole surface pre-exposure by the pre-exposure device(eraser lamp) 5 so that electrical memory in the previous image formation process is erased, and then it is charged uniformly to the negative in the example by the charging means 3.

In this example, the charging means 3 is a magnetic brush contact charging device. The charging device 3 will be described in detail hereinafter(3).

The thus charged surface of the photosensitive member 1 is exposed to and scanned by a laser scanner 2 having an intensity modulated in accordance with image signal fed to the printer A from the image reading device B, corresponding to the intended image information, so that electrostatic latent image thereof is formed in accordance with the image signal.

The laser scanner 2 includes a start light signal generator, a solid laser element, a collimator lens system, a rotatable polygonal mirror (polygonal mirror).

When the rotatable photosensitive drum surface is subjected to the laser scanning exposure L by the laser scanner 2, the solid laser element is rendered on and off at predetermined timing (ON/OFF) by start light signal generator in response to the inputted image signal. The laser beam emitted from the solid laser element is converted into a focal beam through a collimator lens system, and is then deflected by a rotatable polygonal mirror which is rotating at high speed, and then is focus on the photosensitive drum surface 1 as a spot by a fθ lens group. By the laser beam scanning, an exposure distribution of one scan of the image is formed on the photosensitive drum surface 1, and the photosensitive drum surface is scrolled in the perpendicular direction by the rotation of the photosensitive drum 1 after each scan, so that exposure distribution corresponding to the image signal is provided on the rotatable photosensitive drum surface.

The formed electrostatic latent image on the surface of the rotatable photosensitive drum 1 is developed sequentially into a toner image by the developing device 4. In this embodiment, a reverse development system is used. In this example, the developing device 4 is a magnetic brush developing device of a two-component contact type developing system. The developing device 4 will be described in detail hereinafter(5).

On the other hand, a recording material (transfer material) P accommodated in a sheet feeding cassette 8 is, fed out by sheet feeding rollers 8*a* one by one, and is fed into the printer A. It is fed to the transfer portion T in the form of a contact nip between the photosensitive drum 1 and a transfer belt 7 as a transferring means at a predetermined controlled timing by registration rollers 8*b*.

The toner image is electrostatically transferred onto the surface of the transfer material P fed to the transfer portion T, from the surface of the rotating photosensitive drum by a transfer charging blade 7*d* disposed inside the transfer belt 7. The transferring device 7 will be described in detail hereinafter (5).

The transfer material P now having the transferred toner image at the transfer portion T, is sequentially separated from the surface of the photosensitive drum 1, and is fed by an extension of a transfer belt type transferring device 7 to a fixing device 6 where the toner image is heat fixed thereon, and then is discharged onto the sheet discharge tray 100 as a copy or print.

The image forming apparatus of this example is not provided with a cleaning device (cleaner) exclusively for removing the residual toner from the surface of the rotatable photosensitive drum 1 after the toner image transfer, and the developing device 4 has a function of collection or removing the residual toner from the surface of the photosensitive drum 1, namely, the developing device 4 functions also as a cleaning means (cleaner-less system). The rotatable photosensitive drum 1 is used for the repeated image formation. The cleaner-less system will be described in detail in (6) hereinafter.

(2) Photosensitive drum

The photosensitive drum 1 as the member to be charged may be an organic photosensitive member or the like which is normally used. Other usable members are photosensitive members using CdS, Si, Se or another inorganic semiconductor. Desirably, it has a surface layer of a material having a volume resistivity of $10^9$–$10^{14}$ Ωcm on an organic photosensitive member, or it is an amorphous silicon photosensitive member, since the charge injection charging can be used with the advantages of low ozone production and low electric power consumption. The charging property may also be improved.

Figure 2:
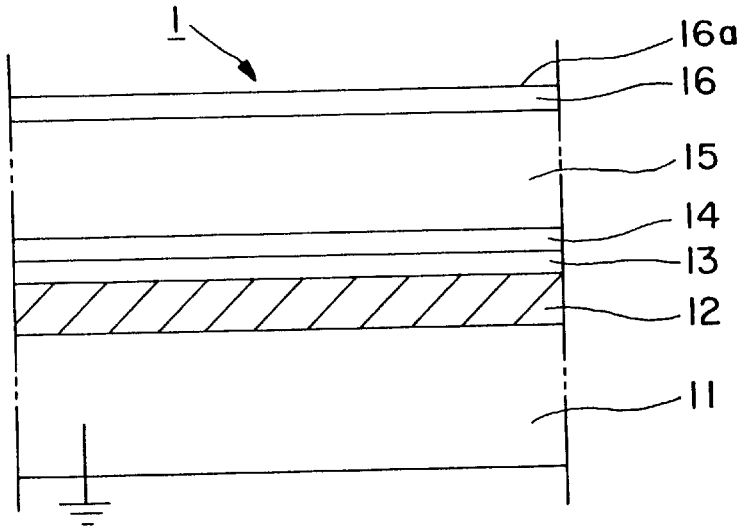
FIG. 2 is a schematic view of layer structure of a photosensitive member.

The photosensitive drum 1 used in this example is a negatively chargeable organic photosensitive member having a surface charge injection layer, and comprises a drum base(aluminum base) of aluminum having a diameter of 30 mm, and following first to fifth layers thereon. FIG. 2 is a schematic view of the layers.

First layer 12: primer layer in the form of an electroconductive layer having a thickness of 20 μm, provided to uniform the aluminum base 11.

Second layer 13: positive charge injection preventing layer in the form of intermediate resistance layer having a thickness of 1 μm and having a volume resistivity of approx. $1\times10^6$ Ωcm adjusted by AMILAN (tradename of polyamide resin material, available from Toray Kabushiki Kaisha, Japan) resin material and methoxymethyl nylon, provided to prevent cancellation of the negative charge on the photosensitive member surface by the positive charge injected from the aluminum base 11.

Third layer 14: charge generating layer of resin material in which disazo pigment is dispersed, having a thickness of approx. 0.3 μm. This layer generates a couple of positive and negative charges upon exposure to light.

Fourth layer 15: charge transfer layer of polycarbonate resin material in which hydrazone is dispersed. This layer is a P-type semiconductor. Therefore, the negative charge on the photosensitive member surface cannot move through this layer, and only the positive charge generated in the charge generating layer can be transferred onto the photosensitive member surface.

Fifth layer 16: this is a charge injection layer and is a coating layer of an insulative resin material binder in which electroconductive fine particles and $SnO_2$ ultra-fine particles 16*a* are dispersed. More particularly, it comprises insulative resin material and 70% by weight, on the basis of the resin material, of $SnO_2$ particles having a particle size of 0.03 μm which are doped with light transmissive electroconductive filler of antimony to reduce the resistance (electroconductive).

Such coating liquid is applied into a thickness of approx. 3 μm through a proper coating method such as dip coating method, spray coating method, roller coating method, beam coating method or the like, thus providing a charge injection layer.

The surface resistance thereof is $10^{13}$ Ωcm. By controlling the surface resistance in such a manner, the direct charging property is improved to permit high quality image formation. The photosensitive member is not limited to an OPC material, but may be of an a-Si material, and a further increase of durability is possible.

The volume resistivity of the surface layer is measured in this manner. Metal electrodes are distributed at the clearance of 200 μm, and liquid surface layer material is supplied therebetween, and is formed into a film, and then, 100V is applied between the electrodes. The measuring temperature is 23° C., and the humidity is 50% RH.

Figure 3:
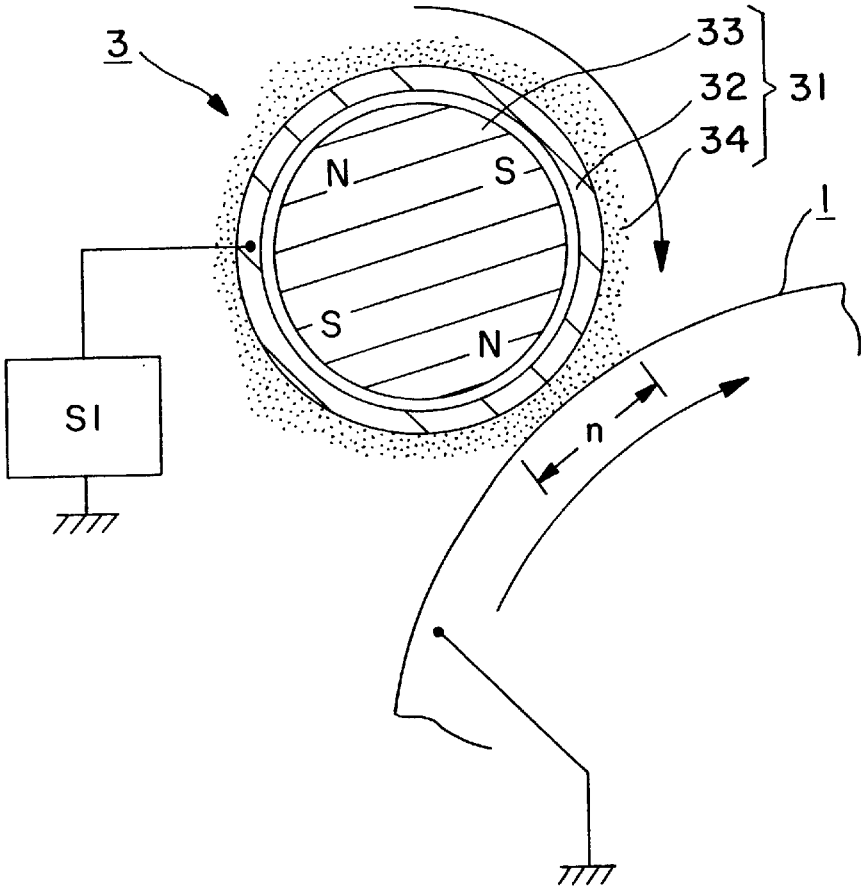
FIG. 3 is a schematic view of a magnetic brush charging member.

(3) Charging device 3 (FIG. 3)

The charging device 3 is a magnetic brush contact charging device. FIG. 3 is a schematic illustration. Designated by 31 is a magnetic brush charging member as a contact charging member contacted to the photosensitive drum 1. The magnetic brush charging member 31 of this example is of a rotatable sleeve type comprising a non-rotatable magnet roller 33, a non-magnetic sleeve (non-magnetic, electroconductive electrode sleeve) 32 fitted rotatably around the magnet roller coaxially therewith, having an outer diameter of 16 mm, and a magnetic brush portion 34 of electroconductive magnetic particle (charging magnetic particles) attracted on the outer surface of the non-magnetic sleeve 32 by the magnetic force of the magnet roller 33 therein.

The magnetic brush charging member 31 is disposed substantially parallel with the photosensitive drum 1 with the magnetic brush portion 34 contacted to the surface of the photosensitive drum 1. The contact nip (charge portion) width n provided between the photosensitive drum 1 and the magnetic brush portion 34 is adjusted to be approx. 5 mm.

The charging magnetic particles for constituting the magnetic brush portion 34 preferably have:

Average particle size of 10–100 μm:

Saturation magnetization of 20–250 emu/cm$^3$

Resistance of $1\times10^2$–$1\times10^{10}$ Ωcm.

In view of the insulation drawback such as pin hole on the photosensitive drum 1, it is preferable that the resistance is not less than $1\times10^6$ Ωcm.

To improve the charging property, lower resistance is preferable, and therefore, in this example, the magnetic particles preferably have:

Average particle size: 25 μm

Saturation magnetization of 200 emu/cm$^3$

Resistance: $5\times10^6$ Ωcm.

The resistance value of the magnetic particles is measured in the following manner: 2 g of the magnetic particles is placed in a metal cell having a bottom surface area of 228 $mm^2$ to which a voltage is applied, and the current is measured when a voltage of 100V is applied.

The average particle size of the magnetic particles, is indicated by a maximum angular distance in the horizontal direction. More than 300 particles are randomly extracted using an optical microscope, and diameters thereof are measured, and the measurements are averaged.

For the magnetic property measurement of the magnetic particle, an automatic DC magnetization B-H property recording device BHH-50. available from Riken Denshi Kabushiki Kaisha, is usable. The particles are filled into a cylindrical container having a diameter(inner diameter)6.5 mm and height 10 mm, at approx. 2 g, and motion of the particles in the container is prevented. The saturation magnetization is measured from the B-H curve.

The magnetic particle may be, for example, a resin material carrier comprising a resin material in which magnetite is dispersed as a magnetic material and in which carbon black is dispersed for electroconductivity and for resistance adjustment, or magnetite alone such as ferrite or the like having an oxidized or deoxidized surface for resistance adjustment, or magnetite alone such as ferrite or the like having a surface coated with resin material for resistance adjustment. In this example, the use is made with ferrite a surface of which is subjected to an oxide or deoxidization process to adjust the resistance.

The non-magnetic sleeve 32 of the magnetic brush charging member 31 is rotated at 150 mm/sec (the peripheral speed of the photosensitive drum 1 is 100 mm/sec) in the counterclockwise direction indicated by an arrow, namely, in the opposite peripheral direction (counter unidirectional) relative to the surface moving direction of the photosensitive drum 1 in the charging region n.

The non-magnetic sleeve 32 is application with a predetermined charging bias from a charging bias applying voltage source S1. In this example, the charging condition is a constant voltage controlled DC bias voltage of −550V.

With rotation of the non-magnetic sleeve 32, the magnetic brush portion 34 rotates in the same direction as the sleeve 32, and in the charging region n it rubs the surface of the photosensitive drum 1, so that electric charge is given to the photosensitive drum 1 from the charging magnetic particle constituting the magnetic brush portion 34, and thus uniformly charging the surface of the photosensitive drum 1 to a predetermined polarity and potential (contact charging).

In this example, as described hereinbefore, the photosensitive drum 1 is provided with a charge injection layer 16 at its surface, and therefore, the photosensitive drum 1 is charged through charge injection charging. By applying a predetermined charging bias voltage to the non-magnetic sleeve 32, the charge is given to the photosensitive drum 1 from the magnetic particles constituting the magnetic brush portion 34, by which the surface of the photosensitive drum 1 is charged to a potential corresponding to the charging bias voltage. The higher the rotational speed of the non-magnetic sleeve 32, the better the charging uniformity.

Figure 4:
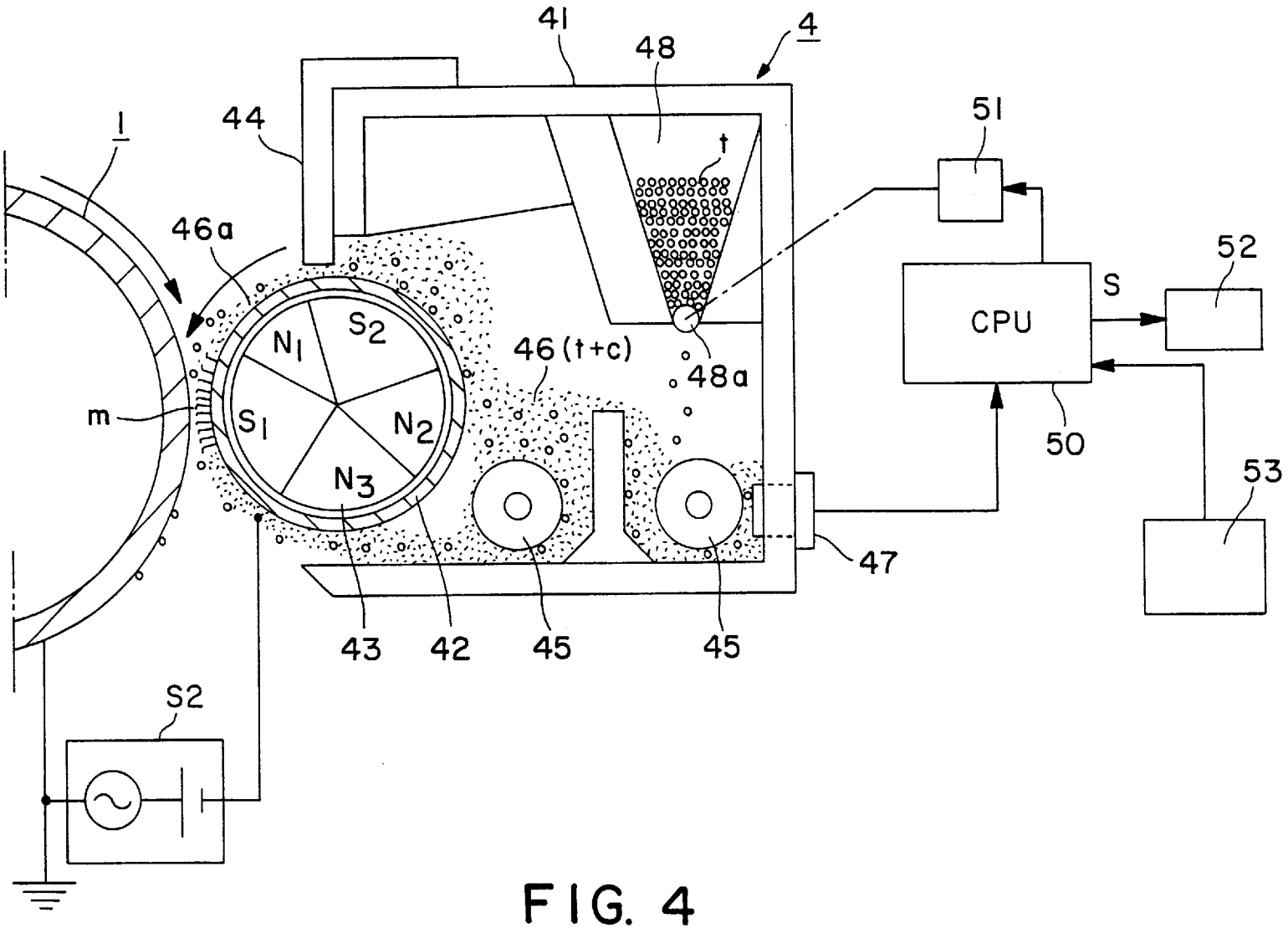
FIG. 4 is a schematic view of a developing device portion and a block diagram of a control system.

(4) Developing device 4 (FIG. 4)

FIG. 4 shows a schematic structure of a developing device 4 used in this example. The developing device 4 uses as a developer a mixture of non-magnetic toner particles and magnetic carrier particles (magnetic carrier for development), and the developer is formed into a magnetic brush layer by magnetic force on the developer carrying member. It is carried to the developing zone (developing zone) of the photosensitive drum 1, and the magnetic brush is contacted to the surface of the photosensitive drum 1 to develop the electrostatic latent image into a toner image (two component magnetic brush contact developing system).

Designated by 41 is a developing container; 42 is a developing sleeve as the developer carrying member; 43 is a magnet roller as a magnetic field generating means stationarily fixed in the developing sleeve 42; 44 is a developer layer thickness regulating blade for forming a thin layer of the developer on developing sleeve surface; 45 is a developer stirring and feeding screw; 46 is the two component developer accommodated in the developing container 41, which comprises non-magnetic toner particles t and magnetic carrier particles c mixed therewith. The two component developer used in this embodiment comprises:

Toner particles t: negative charged toner having an average particle size of 6 $\mu$m which is externally added with titanium oxide having an average particle size of 20 nm (weight ratio 1%):

Carrier c: magnetic carrier having an average particle size of 35 $\mu$m and a saturation magnetization of 205 emu/$cm^3$:

The toner and carrier were mixed at weight ratio of 6:94. The triboelectric charge amount of the toner in the developer was approx. $25\times10^{-3}$ c/kg.

The volume average particle size of the toner is determined, for example, in the following manner.

A measuring apparatus is a Coulter counter TA-II (product of Coulter Co., Ltd.) To this apparatus, an interface (product of NIPPON KAGAKU SEIKI) through which the values of the average diameter distribution and average volume distribution of the toner particles are outputted, and a personal computer (Canon CX-1), are connected. The electrolytic solution is 1% water solution of NaCl (first class sodium chloride).

In measuring, 0.1–5 ml of surfactant, which is desirably constituted of alkylbenzene sulfonate, is added as dispersant in 100–150 ml of the aforementioned electrolytic solution, and then, 0.5–50 mg of the toner particles are added.

Next, the electrolytic solution in which the toner particles are suspended is processed approximately 1–3 minutes by an ultrasonic dispersing device. Then, the distribution of the toner particles measuring 2–40 microns in particle size is measured with the use of the aforementioned Coulter counter TA-2, the aperture of which is set at 100 microns, and the volumetric distribution of the toner particles is obtained. Finally, the volumetric average particle size of the toner particles is calculated from the thus obtained volumetric distribution of the toner particles.

The developing sleeve 42 is so disposed that at least at the time of the developing operation, it is placed with the closest distance from the photosensitive drum 1 being approx. 500 $\mu$m, So that magnetic developer brush thin layer 46*a* on the outer surface of the developing sleeve 42 is contacted to the surface of the photosensitive drum 1. The contact nip m between the magnetic developer brush layer 46*a* and the photosensitive drum 1 is a developing zone.

The developing sleeve 42 is rotated around the stationary magnet roller 43 in the counterclockwise direction indicated by the arrow at a predetermined rotational speed. In the developing container 41, a magnetic brush of the developer 46 is formed on the outer surface of the sleeve by the magnetic force of the magnet roller 43. The magnetic developer brush is fed with the rotation of the sleeve 42, and is subjected to layer thickness regulation by the blade 44 so as to be a magnetic developer brush thin layer 46*a* having a predetermined layer thickness, and is carried out of the developing container to the developing zone. It is contacted to the surface of the photosensitive drum 1, and is returned into the developing container 41 by the continuing rotation of the sleeve 42.

With the rotation of the developing sleeve 42, the developer 46 is taken by the N2 pole of the magnet roller 43, and is conveyed by the S2 pole—N1 pole, during which it is regulated by the regulating blade 44 disposed perpendicularly relative to the developing sleeve 42, so that thin layer 46*a* of the developer 46 is formed on the developing sleeve 42. The developer layer 46*a* thus formed in the thin layer is fed to the position of the main developing pole $S_1$ in the developing zone, where it is reformed as chains of developer by the magnetic force. By the developer layer 46*a* in the form of chains, the electrostatic latent image on the photosensitive drum 1 is developed into a toner image, and thereafter, by the repelling magnetic field formed between the thereafter $N_3$ pole and the $N_2$ pole, the developer on the developing sleeve 42 is returned into the developing container 41. Between the developing sleeve 42 and the electroconductive drum base of the photosensitive drum 1, a developing bias in the form of a DC voltage plus alternating voltage, is applied from a developing bias applying voltage source S2.

In this example, the developing bias voltage is as follows:

DC voltage: −480V

Alternating voltage: amplitude Vpp=1500V, frequency Vf=3000 Hz.

With the developing bias, the toner t in the magnetic developer brush thin layer 46*a* on the Vpp=1500V is selectively deposited onto the electrostatic latent image on the photosensitive drum 1 in the developing zone to develop the electrostatic latent image into a toner image.

Generally, the application of the alternating voltage is effective to increase the development efficiency so that image quality is improved in the two-component developer type developing method, but the fog tends to be produced. Therefore, a potential difference is provided between the DC voltage applied normally to the developing sleeve 42 and the surface potential (dark portion potential) of the photosensitive drum 1, by which the fog production is prevented. The potential difference for removing the fog is called a fog removing potential (Vback), by which the deposition of the toner on the photosensitive drum 1 at the non-image region is prevented during the developing operation.

In a developing device using the two component developer, the toner in the developer is gradually consumed for the development of the electrostatic latent image, and it the toner supplement is not effected, the toner content in the developer (T/C ratio (ratio of the toner amount relative to the amount of the carrier)) gradually decreases, and the image density of the output image is decreased. Therefore, a sensor 47 for detecting the toner content in the developer 46 in the developing container 41 is provided, and the amount of the toner t is supplied into the developer 46 from the supplement portion 48 corresponding to the toner consumed by the development on the basis of the toner content detected information detected by the sensor 47, by which the T/C ratio in the developer 46 is kept in a predetermined constant range (developer density control system).

The toner content detecting sensor 47 uses a magnetic permeability change of the developer, and detects the apparent magnetic permeability $\mu$ of the magnetic carrier included in the developer in a predetermined volume of the developer adjacent the sensor using the inductance of the coil. The sensor 47 per se is known.

The magnetic permeability information of the developer 46 outputted from the sensor 47 during the developing device operation, is supplied to the control circuit (CPU) 50, which detects the T/C ratio of the developer 46 in the developing container on the basis of the input information. When the magnetic permeability of the developer 46 increases, the event means that T/C ratio of the developer 46 is decreased (low toner content), and when the toner content of the decrease in the T/C ratio of the developer 46 decreases, the event means that T/C ratio of the developer 46 is increases (high toner content).

When the T/C ratio detected becomes lower than a predetermined lower limit, a toner supply shaft 48*a* of a toner supplement portion 48 is driven through a driver 51, so that toner supply is started from the toner supplement portion 48 to the developer 46 In the developing container. Supplied toner is introduced to and dispersed in the developer 46 by stirring screws 45, 45.

By the toner supply, the T/C ratio of the developer in the developing container increases, and the magnetic permeability information of the developer is inputted from the sensor 47 to the control circuit 50, and the control circuit 50 determines the T/C ratio of the developer 46 in the developing container. When the T/C ratio detected reaches a predetermined upper limit, the control circuit 50 stops driving of the toner supply shaft 48*a* of the toner supplement portion 48 through a driver 51, thus terminating the toner supply.

Through such a sequence, T/C the ratio of the developer 46 in the developing container is controlled and maintained in a predetermined range of the developer toner content.

As regards the position of the sensor 47, it is provided on a side wall surface of the developer stirring chamber in the developing container 41 in this embodiment, but it may be placed at another place if there is a sufficient thickness of the developer which on the sensor surface of the toner content detecting sensor 47 so that toner content detection is possible, and if the flow of the developer is constant during the developer stirring, namely, the flow speed of the developer flowing along the sensor surface is constant during the developer stirring, and the fluid is regular.

(5) Transferring device 7

The transferring device 7 in this example is in the form of a transfer belt type, as has been mentioned hereinbefore. Designated by 7*a* is an endless transfer belt, and is stretched around the driving roller 7*b* and the follower roller 7*c,* and is rotated substantially at the same peripheral speed as the peripheral speed of the photosensitive drum 1 in the same peripheral moving direction. Designated by 7*d* is a transfer charging blade disposed inside the transfer belt 7*a,* and forms a transfer nip T by pressing the upper portion of the transfer belt 7*a* to the photosensitive drum 1, and a transfer bias is applied thereto from a transfer bias application voltage source S3 to charge it to the opposite polarity from the toner at the back side of the transfer material P. By this, the toner image is sequentially and electrostatically transferred from the rotatable drum 1 onto the surface of the transfer material P passing through the transfer portion T.

In this example, the belt 7*a* is of polyimide resin material and has a film thickness of 75 $\mu$m.

The material of the belt 7*a* is not limited to polyimide resin material, but may be of polycarbonate resin material, polyethylene terephthalate resin material, polyvinylidene fluoride resin material, polyethylenenaphthalate resin material, polyetheretherketone resin material, polyether sulfone resin material, polyurethane resin material or another plastic resin material, or a fluorine or silicon rubber. As regards the thickness, it is not limited to 75 $\mu$m, but may range approx. 25–2000 $\mu$m, preferably 50–150 $\mu$m.

The transfer charging blade 7*d* has a resistance of $1\times10^5$–$1\times10^7\Omega$, a thickness of 2 mm, and a length of 306 mm. The transfer charging blade 7*d* is supplied with a bias of +15 $\mu$A under a constant-current-control to effect the image transfer.

(6) Cleaner-less system

The image forming apparatus of this example is a cleaner-less system (toner recycling system), and therefore, the toner particles remaining on the photosensitive drum 1 after toner image transfer onto the transfer material P (untransferred toner) is carried over to the charge portion n of the photosensitive drum 1 and is introduced to the magnetic brush portion 34 of the magnetic brush charging member 31 of the magnetic brush contact charging device 3, and is temporarily collected.

The untransferred toner on the photosensitive drum 1 may frequently contain positive and negative particles due to the separation discharge or the like during the or the like operation. Such untransferred toner particles reach to the magnetic brush charging member 31, and are introduced in the magnetic brush portion 34. The collection of the untransferred toner into the magnetic brush portion 34 of the magnetic brush charging member 31 can be more effectively carried out by oscillating electric field effect between the magnetic brush charging member 31 and the photosensitive drum 1 provided by the application of the AC voltage component to the magnetic brush charging member 31.

All of the untransferred toner collected by the magnetic brush portion 34 is charged to the negative polarity by the triboelectric charge with the magnetic particles of the magnetic brush, and then is ejected onto the photosensitive drum 1 by the potential difference between the charged potential of the photosensitive drum 1 and the DC component applied to the charging member 31. With the movement of the toner to the photosensitive drum 1 from the charging member 31, the photosensitive drum 1 is charged, and the photosensitive drum 1 having the remaining toner is exposed to image light by the laser scanner 2 over the remaining toner so that electrostatic latent image is formed. The untransferred toner ejected to the photosensitive drum 1 and having the same polarity, is conveyed to the developing zone m, where it is collected into the developing device by the simultaneous development and cleaning with the fog removing electric field. Simultaneously with the formation of the developing electric field which deposits the toner from the developing sleeve 42 to the light portion of the photosensitive drum, a cleaning electric field for collecting the toner onto the developing sleeve 42 from the dark portion of the photosensitive drum is formed.

When the image region is longer than the circumferential length of the photosensitive drum 1, the simultaneous collection of the untransferred toner by the developing device 4, is effected simultaneously with the image formation process including the charging, exposure, development and the transfer operations.

Thus, the untransferred toner is reused for the development after it is collected back into the developing device 4, and therefore, the residual toner to be disposed of can be eliminated. The advantage regarding the space saving is significant, so that remarkable downsizing of the image forming apparatus is possible.

Normally, the toner particles have a relatively high electric resistance, and therefore, the introduction of the toner particles in the magnetic brush portion 34 of the magnetic brush charging member 31 increases the resistance of the magnetic brush portion 34 and is one of factors of deteriorating the charging power. However, the amount of the untransferred toner introduced in the magnetic brush portion 34 of the magnetic brush charging member 31 by being carried over to the charge portion is small, and the toner is discharged from the magnetic brush portion 34, and the tolerable amount of the introduced toner is relatively large. Therefore, the introduction is practically not a problem.

In addition, the toner particles ejected to the photosensitive drum 1 from the magnetic brush portion 34 are very uniformly distributed thereon, and therefore, the subsequent image exposure process is not adversely affected, substantially. No ghost image attributable to the untransferred toner pattern is produced.

(7) Detection and warning of reduction the magnetic particle in the magnetic brush charging member 31

However, when the apparatus of the magnetic brush contact charging type, transfer type and the cleaner-less system type, is subjected to an emergent stop due to the sheet jam(Jam), power failure or the like in the process of the image formation process, and then the operation is resumed, the large amount of the toner particle of the untransferred toner image remaining on the member to be charged before the stop is collected by the magnetic brush portion of the magnetic brush charging member once the toner.

Then, the mixing toner content in the magnetic brush portion suddenly increases. If the amount thereof exceeds the tolerable level, the ejection of the toner from the magnetic brush portion becomes not enough. This results decrease of the charging power due to the rise of the resistance of the magnetic brush portion, and therefore, the potential difference between the potential of the member to be charged and the potential applied to the magnetic brush charging member becomes so large that magnetic particles constituting the magnetic brush portion are deposited on the member to be charged from the magnetic brush portion, abnormally.

The decrease of the disengagements from the magnetic particle results in the decrease of the charging power (improper charging, charging non-uniformity) so that photosensitive drum 1 is not charged to the desired potential, and the removal of the magnetic particles are further increased, and the defective images results.

cleanerless. as a result, image defect may occur.

According to this embodiment, the decrease of the magnetic particles in the magnetic brush portion 34 of the magnetic brush charging member 31 is detected, so that abnormal state is recognized, so that production of a large amount of the improper copies or prints. This will be described in detail.

When the magnetic particles are abnormally disengaged from the magnetic brush charging member 31 of the magnetic brush contact charging device 3 due to the above-described situation, and a large amount of the magnetic particles are introduced in the developing zone m of the photosensitive drum 1 and are collected into the developing device 4. The degree of the output change (amount of decrease of the T/C ratio per unit time) of the toner content detecting sensor 47 resulting from such event is larger than the degree of output change in the normal operation in which the toner decreases by the normal development for the electrostatic latent image. Therefore, the large degree of the output change means that large amount disengagement of the magnetic particles from the magnetic brush charging member 31 occurs and are introduced in the developer 46 of the developing device 4, and therefore, the amount of the magnetic particles in the magnetic brush charging member 31 has reduced.

Therefore, the degree of the output change of the toner content detecting sensor 47 is compared with a predetermined output change rate by the control circuit (CPU) 50, and if it is larger than the predetermined output change rate, it is discriminated that T/C ratio variation is not due to the toner consumption of the normal electrostatic latent image development, but the abnormal disengagement of the magnetic particles from the magnetic brush charging member 31 occurs, and therefore, the amount of the magnetic particles of the magnetic brush charging member 31 has reduced beyond a tolerable level, and the control circuit (CPU) 50 produces a signal S.

The signal is used for the warning for promoting the user to exchange the Image formation cartridge(process cartridge) containing the magnetic brush charging member or the magnetic brush charging member or for the emergency stop of the image forming apparatus. Designated by 52 is a warning displaying means in the form of a lamp, buzzer or the like.

Figure 5:
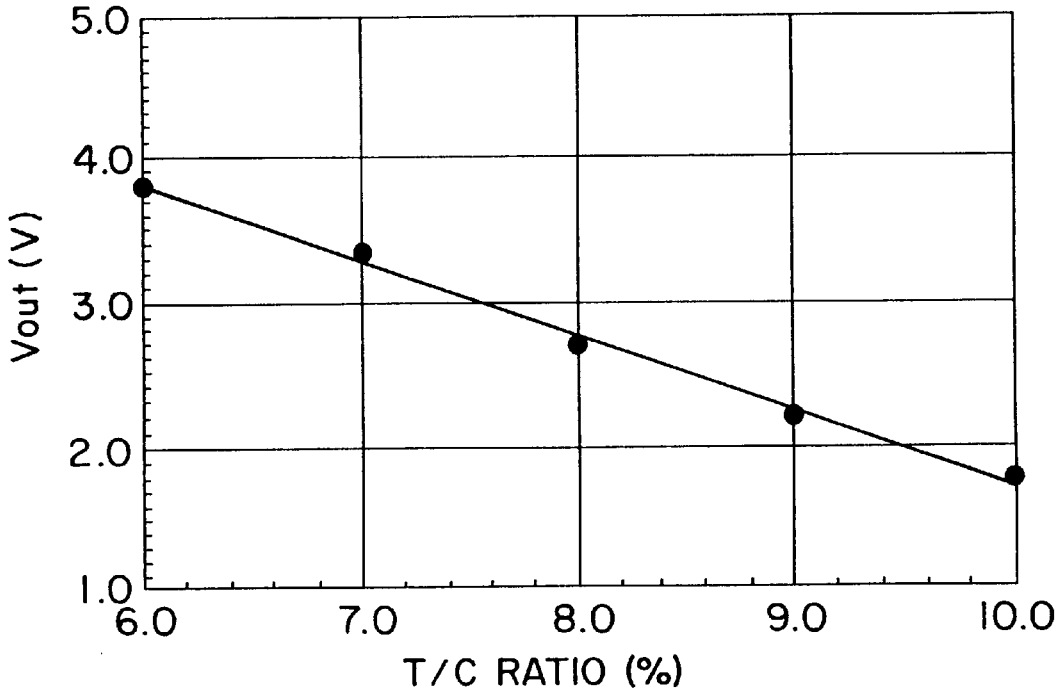
FIG. 5 shows a relationship between a T/C ratio of developer and an output of a toner content detecting sensor.

Thus, the decrease of the magnetic particles beyond the tolerable level in the magnetic brush portion 34 of the magnetic brush charging member 31 is properly detected, and the increase of production of erroneous copies or prints due to the situation can be avoided. More particularly, FIG. 5 shows the results of experiments of the inventors, which shows the output Vout(V) of the toner content detecting sensor 47 when T/C the ratio of the developer 46 in the developing device 4 is changed from 6% to 10% by 1%.

Figure 6:
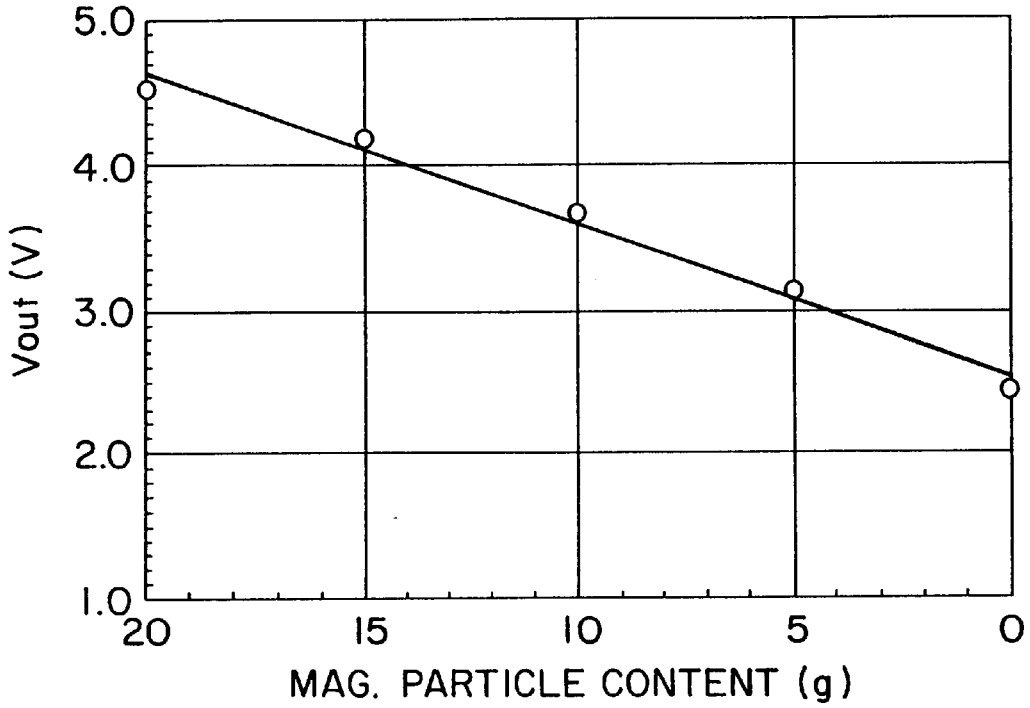
FIG. 6 shows a relationship between the amount of the magnetic particles for the charging introduced in the developer of the developing device and an output of the toner content detecting sensor.

FIG. 6 shows the output of the toner content detecting sensor 47 when the charging magnetic particles are forcedly introduced in the developing device 4 containing the developer 46 of the T/C ratio of 8%.

The toner consumption amount in 1 sec when whole surface solid black printing is effected on a transfer material P of A3 size is approx. 0.45 g, and the lsec required for 1% (T/C ratio) of the toner to be consumed with the whole surface solid black printing on A3 size sheet, is approx. 4.5 sec. The actual detection of the 1% change by the toner content detecting sensor 47 is approx. 20 sec after the event because of the distance between the toner content detecting sensor 47 and the developing sleeve 42.

When the magnetic particles in the magnetic brush charging member 31 disengage and is introduced in the developer 46 in the developing device from the developing sleeve 42, the time required for the output of the toner content detecting sensor 47 to make the change corresponding to 1% change of T/C ratio is approx. 5 sec in this situation.

Therefore, when the output change rate of the toner content detecting sensor 47 is larger than the output change rate (change width per unit time) $t_c$ (V/sec) of the toner content detecting sensor 47 in the developing device 4 when the most toner-consuming image is developed, then the control circuit 50 recognizes that T/C ratio variation is not by the toner consumption of normal development operation but by the abnormal disengagement of the magnetic particles in the magnetic brush charging member 31 (due to the sheet jam, power failure or forced voltage source off, and a signal indicative of the event is produced.

By this, the user can be notified of the event that amount of the magnetic particles in the magnetic brush portion 34 of the magnetic brush charging member 31 is reduced beyond a tolerable level, so that wasteful copying operation thereafter can be avoided.

<Embodiment 2>

In this embodiment, the image forming apparatus is provided with a video counter 53 (FIG. 4). The other structures are the same as with Embodiment 1.

The image signal is converted to a digital signal by an analog—digital conversion device, and the output level of the converted signal is integrated for each pixel. It is then converted to a video count by a video counter 53 and is then supplied to the control circuit (CPU) 50.

The control circuit 50 calculates the toner consumption amount on the basis of the video count, and predicts the varying T/C ratio. In this embodiment, when the output change rate of the toner content detecting sensor 47 disposed in the developing device 4 is larger than $t_c$ (V/sec), the comparison is made between the changing rate and a change rate of the T/C ratio predicted on the basis of the input from the video counter 53. When the actually measured change rate is larger than the T/C ratio change rate predicted on the basis of the input from the video counter 53, the control circuit 50 recognizes the change of the T/C ratio variation is not by the toner consumption due to the normal developing operation, but by the abnormal disengagement of the magnetic particles from the magnetic brush charging member 31 described above, and the signal indicative of the event is produced.

By this, the user can be notified of the event that amount of the magnetic particles in the magnetic brush portion 34 of the magnetic brush charging member 31 is reduced beyond a tolerable level, so that wasteful copying operation thereafter can be avoided.

<Others>

1) The magnetic brush charging member 31 is not limited to the rotatable sleeve type described above, but may be a rotatable magnet roller, the rotatable magnet roller having a surface having been subjected to electroconductivity treatment for function as an electric energy supply electrode it necessary, on which surface the electroconductive magnetic particles a magnetically confined directly thereon to form a magnetic brush portion. It may be a non-rotatable magnetic brush charging member.

2) the member to be charged (image bearing member) in the form of a photosensitive member preferably has a surface resistance of $10^9$–$10^{14}$ Ωcm (low resistance layer), since then the injection charging can be accomplished, and the ozone production can be avoided, but another organic photosensitive member or the like is usable. In other words, the type of the contact charging is not limited to the injection charging type of the embodiment, but may be a contact charging type in which the discharge phenomenon is dominant.

3) the toner particles t in the developer 46 may be pulverized toner, but polymerized toner is preferable since then the simultaneous development and cleaning is more effective.

4) the waveform of the AC voltage applied to the magnetic brush charging member 31 or the developing sleeve 42 may be a sunisoidal wave, a rectangular wave, triangular wave or the like. It may be a rectangular wave produced by periodically actuate and deactuate a DC current In other words, the waveform of the alternating voltage applied, as the charge bias, to a charging member or a development member may be optional as long as the voltage value periodically changes.

5) The choice of the means for exposing the surface of an image bearing member to form an electrostatic latent image does not need to be limited to the laser based digital exposing means described in the preceding embodiments. It may be an ordinary analog exposing means, a light emitting element such as a LED, or a combination of a light emitting element such as a fluorescent light and a liquid crystal shutter. In other words, it does not matter as long as it can form an electrostatic latent image correspondent to the optical information of a target image.

The image bearing member may be an electrostatic recording dielectric member or the like. In such a case, the dielectric member surface is uniformly charged (primary charging) to a predetermined polarity and potential, and thereafter, the selective discharging is effected by discharging needle head, electron gun or another discharging means to form an intended electrostatic latent image.

6) the developing device may be reverse development type or regular developing type.

7) the transfer material which receives the toner image from the image bearing member may be an intermediary transfer member such as a transfer drum, a transfer belt.

8) the image formation process of the image forming apparatus is not limited to that of embodiment. Additional assisting process means are usable.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

charging means including magnetic particles contactable to said image bearing member;

electrostatic image forming means for forming an electrostatic image on said image bearing member charged by said charging means;

developing means for developing the electrostatic image on said image bearing member with a developer including toner and magnetic carrier;

detecting means for detecting a toner content of the developer;

toner supply means for supplying the toner into said developing means when the toner content detected by said detecting means is lower than a predetermined level of the toner content;

calculating means for calculating a changing rate of the toner content from an output of said detecting means; and warning means for warning that a changing rate of the toner content is larger than a predetermined level of the changing rate.

2. An apparatus according to claim 1, wherein said detecting means detects a magnetic permeability.

3. An apparatus according to claim 1, wherein said charging means is supplied with a voltage.

4. An apparatus according to claim 3, wherein said voltage is a superimposed voltage of an AC voltage and a DC voltage.

5. An apparatus according to claim 1, wherein charge on the image bearing member is determined on the basis of image information for forming the electrostatic image.

6. An apparatus according to claim 1, wherein said image bearing member is provided with a surface layer having a volume resistivity of $10^9$–$10^{14}$ Ωcm.

7. An apparatus according to claim 6, wherein said surface layer comprises resin material and electroconductive particles dispersed therein.

8. An apparatus according to claim 7, wherein said image bearing member is provided with a photosensitive layer provided inside said surface layer.

9. An apparatus according to claim 6, wherein said image bearing member is provided with a photosensitive layer provided inside said surface layer.

10. An apparatus according to claim 1, wherein a developing operation for developing the electrostatic image with the developer and a cleaning operation for collecting a residual toner from said image bearing member, are carried out simultaneously.

* * * * *

UNITED STATES PATENT AND TRADEMARK OFFICE

CERTIFICATE OF CORRECTION

PATENT NO. : 6,052,545

DATED : April 18, 2000

INVENTOR(S) : Yoshiyuki KOMIYA et al.

It is certified that error appears in the above-identified patent and that said Letters Patent is hereby corrected as shown below:

On the title page:

ITEM [56]

"4368975" should read --4-368975--.

COLUMN 1

Line 11, "charged(image" should read --charged (image--;
Line 46, "there to," should read --thereto,--;
Line 60, "roller(charging roller)." should read --roller (charging roller)).--; and
Line 63, "a" should be deleted.

COLUMN 3

Line 33, "as;" should read --as--; and
Line 37, "means(cleaner)" should read --means (cleaner).

COLUMN 4

Line 29, "particle" should read --particles--; and
Line 52, "to" should be deleted.

UNITED STATES PATENT AND TRADEMARK OFFICE

CERTIFICATE OF CORRECTION

PATENT NO. : 6,052,545

DATED : April 18, 2000

INVENTOR(S) : Yoshiyuki KOMIYA et al.

It is certified that error appears in the above-identified patent and that said Letters Patent is hereby corrected as shown below:

COLUMN 6

Line 2, "Output" should read --output--;
Line 15, "signal(image" should read --signal (image--;
Line 18, "member(photosensitive" should read --member (photosensitive);
Line 29, "device(eraser" should read --device (eraser); and
Line 54, "focus" should read --focused--.

COLUMN 7

Line 49, "base(aluminum" should read --base (aluminum--; and
Line 54, "uniform" should read -make uniform--.

COLUMN 8

Line 45, "particle" should read --particles--; and
Line 56, "μm:" should read --μm--.

COLUMN 9

Line 13, "BHH-50." should read --BHH-50,--;
Line 15, "diameter(inner diameter)6.5" should read --diameter (inner diameter) 6.5--; and
Line 37, "application" should read --applied--.

CERTIFICATE OF CORRECTION

PATENT NO. : 6,052,545

DATED : April 18, 2000

INVENTOR(S) : Yoshiyuki KOMIYA et al.

It is certified that error appears in the above-identified patent and that said Letters Patent is hereby corrected as shown below:

COLUMN 10

Line 20, "1%):" should read --1%);--;
Line 22, "emu/cm$^3$:" should read --emu/cm$^3$-; and
Line 53, "So" should read --so--.

COLUMN 11

Line 47, "it" should read --if--.

COLUMN 12

Line 9, "increases" should read --increased--;
Line 14, "In" should read --in--;
Line 24, "of" (first occurrence) should be deleted;
Line 27, "T/C the" should read --the T/C--;
Line 34, "which on" should read --on which--; and
Line 35, "sensor 47 so that" should read --(sense)--.

COLUMN 13

Line 10, "is" should read --are--;
Line 17, "the or the like" should read -- --; and
Line 18, "to" should be deleted.

CERTIFICATE OF CORRECTION

PATENT NO. : 6,052,545

DATED : April 18, 2000

INVENTOR(S) : Yoshiyuki KOMIYA et al.

It is certified that error appears in the above-identified patent and that said Letters Patent is hereby corrected as shown below:

COLUMN 14

Line 2, "portion" should read --portion in--;
Line 17, "jam" should read -- --;
Line 19, "particle" should read --particles--;
Line 22, "once the toner." should be deleted;
Line 26, "results" should read --results in--;
Line 36, "particle" should read --particles--;
Line 41, "cleanerless." should be deleted; and
Line 42, "results." should be --result,-.

COLUMN 15

Line 12, "Image" should read --image-- and "cartridge(process" should read --cartridge (process--;
Line 25, "T/C the" should read --the T/C--; and
Line 41, "is" should read --are--.

COLUMN 16

Line 30, "it" should read --if--;
Line 32, "a" (first occurrence) should read --are--;
Line 35, "2) the" should read --2) The--;
Line 45, "3) the" should read --3) The--;
Line 47, "is" should read --are--;

UNITED STATES PATENT AND TRADEMARK OFFICE

CERTIFICATE OF CORRECTION

PATENT NO. : 6,052,545

DATED : April 18, 2000

INVENTOR(S) : Yoshiyuki KOMIYA et al.

It is certified that error appears in the above-identified patent and that said Letters Patent is hereby corrected as shown below:

COLUMN 16 (CONTINUED)

Line 49, "4) the" should read --4) The--;
Line 51, "sunisoidal" should read --sinusoidal--; and
Line 53, "actuate and deactuate" should read --actuating and deactuating-- and "current" should read --current.--.

COLUMN 17

Line 8, "6) the" should read --6) The--;
Line 10, "7) the" should read --7) The--; and
Line 13, "8) the" should read --8) The--.

COLUMN 18

Line 24, "claim 7," should read --claim 6,--; and
Line 27, "claim 6," should read --claim 7,--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*